US005941655A

United States Patent [19]

Jacobs et al.

[11] Patent Number: 5,941,655

[45] Date of Patent: Aug. 24, 1999

[54] DIRECTION-INDICATING PAVEMENT MARKING HAVING RAISED PROTUBERANCES AND METHOD OF MAKING

[75] Inventors: Gregory F. Jacobs, Woodbury, Minn.; Larry K. Stump, Hudson, Wis.

[73] Assignee: 3M Innovative Properties Company, St. Paul, Minn.

[21] Appl. No.: 08/895,128

[22] Filed: Jul. 16, 1997

[51] Int. Cl.[6] ..... E01F 9/04; G02B 5/28

[52] U.S. Cl. ..... 404/14; 404/82; 116/63 R; 116/DIG. 41; 428/141

[58] Field of Search ..... 404/14, 16, 9, 404/82; 116/63 R, DIG. 16, DIG. 41; 428/325, 141

[56] References Cited

U.S. PATENT DOCUMENTS

| | | | |
|---|---|---|---|
| 3,043,196 | 7/1962 | Palmquist et al. | 88/82 |
| 3,171,827 | 3/1965 | De Vries et al. | 260/40 |
| 3,175,935 | 3/1965 | Vanstrum | 156/3 |
| 3,274,888 | 9/1966 | Vanstrum et al. | 88/82 |
| 3,418,896 | 12/1968 | Rideout | 94/1.5 |
| 3,556,637 | 1/1971 | Palmquist | 350/105 |
| 4,035,059 | 7/1977 | DeMaster | 350/105 |
| 4,040,760 | 8/1977 | Wyckoff | 404/14 |
| 4,490,432 | 12/1984 | Jordan | 428/220 |
| 4,564,556 | 1/1986 | Lange | 428/325 |
| 4,758,469 | 7/1988 | Lange | 428/325 |
| 4,772,511 | 9/1988 | Wood et al. | 428/325 |
| 4,931,414 | 6/1990 | Wood et al. | 501/103 |
| 4,937,127 | 6/1990 | Haenggi et al. | 428/148 |
| 4,983,458 | 1/1991 | Dejaiffe | 428/402 |
| 4,988,541 | 1/1991 | Hedblom | 427/163 |
| 4,988,555 | 1/1991 | Hedblom | 428/172 |
| 5,053,253 | 10/1991 | Haenggi et al. | 427/204 |
| 5,094,902 | 3/1992 | Haenggi et al. | 428/150 |
| 5,124,187 | 6/1992 | Aeschbacher et al. | 428/40 |
| 5,194,113 | 3/1993 | Lasch et al. | 156/243 |
| 5,286,682 | 2/1994 | Jacobs et al. | 501/34 |
| 5,417,515 | 5/1995 | Hachey et al. | 404/15 |
| 5,643,655 | 7/1997 | Passarino | 428/143 |
| 5,750,191 | 5/1998 | Hachey et al. | 427/185 |
| 5,777,791 | 7/1998 | Hedblom | 404/14 X |

FOREIGN PATENT DOCUMENTS

| | | | |
|---|---|---|---|
| 884 100 | 10/1971 | Canada | 404/14 |
| 0 373 826 A2 | 6/1990 | European Pat. Off. . | |
| 0 397 406 A1 | 11/1990 | European Pat. Off. . | |
| 0 565756 A1 | 10/1993 | European Pat. Off. . | |
| 0 683 268 A2 | 11/1995 | European Pat. Off. . | |
| 0 683 269 A2 | 11/1995 | European Pat. Off. . | |
| 5-33661 | 4/1988 | Japan . | |
| 5-33661 | 5/1993 | Japan . | |

*Primary Examiner*—Terry Lee Melius
*Attorney, Agent, or Firm*—David R. Cleveland

[57] ABSTRACT

Retroreflective article (10), e.g., in the form of a pavement marking, having raised, nonintegral protuberances (16) that exhibit good dry retroreflectivity and recover retroreflectivity quickly after exposure to water. The protuberances may comprise a thermoplastic polymer body and have at least two different portions. Partially embedded in the protuberances are different sets of optical elements (14) which are in optical association with a light scattering agent. The protuberances are disposed on top of a conformable base sheet (12).

32 Claims, 2 Drawing Sheets

DIRECTION-INDICATING PAVEMENT MARKING HAVING RAISED PROTUBERANCES AND METHOD OF MAKING

TECHNICAL FIELD

The present invention pertains to a direction indicating retroreflective pavement marking that uses raised protuberances and, partially embedded in the protuberances, a plurality of optical elements having different properties, for example, color or refractive index, to allow the marker to display a different image from a different direction.

BACKGROUND

Pavement markings—e.g., paints, tapes, and individually mounted articles—are commonly used to guide and direct motorists traveling along a roadway. During the daytime, the markings are usually sufficiently visible to guide motorists. At nighttime, however, when the primary source of illumination is the vehicle headlights, the marking may not be sufficiently bright to guide the motorist unless it retroreflects light. Retroreflective pavement markings have the ability to return substantial quantities of incident light in the direction from which the light originated. For this reason, retroreflective pavement markings are commonplace on roadways.

Many retroreflective pavement markings, such as lines on highways, are made by dropping optical elements, such as glass beads, onto the line while it is still tacky. Others are made by securing optical elements to a base sheet that contains pigments and fillers. Securement is typically achieved either by embedding the elements into the base sheet or by securing the elements to the base sheet with a binder. The pigments and fillers typically are dispersed throughout the base sheet for several reasons, such as reducing cost, improving durability, and providing conformability. Pigments also enhance pavement marking visibility and can play a role in the retroreflective mechanism.

Incident light retroreflects from pavement markers in the following manner. First, the incident light passes through the optical elements to strike the pigments in the base sheet or in the bonding material of the marker. The pigments then scatter the incident light back into the microspheres, and the microspheres redirect a portion of the scattered light towards the light source. For effective retroreflection, especially under wet conditions, the microspheres preferably are elevated above the surface of the pavement so that they will not be submerged in water during a rainy period.

An example of a pavement marker where the microspheres are elevated is disclosed in U.S. Pat. No. 4,988,555 to Hedblom (referred to as Hedblom '555). This pavement marker contains a pattern of protrusions that have vertical surfaces where microspheres are embedded so as to be elevated above the pavement surface. The microspheres are elevated and are oriented vertical to the incident light, to provide more efficient retroreflection. Because of their elevated position, the microspheres often are not completely submerged in water. The protrusions also allow the water to drain more efficiently from the marker so that retroreflective performance can recover more quickly after rainfall has ceased.

While patterned pavement markers have become very useful articles, their manufacturing process is somewhat complex. For example, as disclosed in U.S. Pat. No. 4,988,541 (Hedblom), the integral protrusions are created by embossing a sheet of polymeric material using an embossing roll that has a predetermined pattern of recesses. As the polymeric material fills the recesses in the embossing roll, protrusions having set pattern, dimensions, and spacing are formed. After the embossing process, binder materials are carefully placed on the protrusions in a manner that keeps the binder from flowing into the valleys between the protrusions. Microspheres and/or skid resistant particles are then secured to the binder material. Not only is this process somewhat complicated, but changing the protrusion pattern or shape, size, or spacing requires changing the embossing roll, which typically requires labor and extended amounts of time. With each different protrusion pattern, there must be a corresponding embossing roll.

Hedblom '555 also disclosed a pavement marking that can retroreflect light in two different colors by using different color bead bonds. The bead bonds coat the protrusions' vertical sides and support the microspheres. The pigments in the bead bond contribute to the retroreflected light's color. For example, a first bead bond layer facing a first direction can retroreflect white light by using $TiO_2$ pigment while a second bead bond layer facing a second direction can retroreflect yellow light through the use of lead chromate pigment. The reference also discloses that other color/pigment combinations may be used to provide alternative signal information to drivers.

U.S. Pat. No. 4,040,760 (Wyckoff) discloses another example of an enclosed lens direction indicating pavement marker. The pavement marker has optical elements that are embedded in a polymeric binder layer. This pavement marker has a saw-tooth cross section with each wedge having a relatively long surface inclining upwardly at a small acute angle and a relatively short surface inclining downwardly substantially normal to the upwardly inclining surface. The downwardly inclining surface is disclosed as being reflective, integrally covered, and has a predetermined color. The reflective surface is made by embedding the optical elements with an associated reflective surface in a transparent binder layer. Both the optical elements and the binder may be colored. The upwardly inclining surface has a different color than the downwardly inclining surface and has optically diffuse reflecting properties, such as, for example white paper or flat paint. The reference also discloses that the upwardly inclining surface may be retroreflective. As an example, the downwardly inclining surface retroreflects red light while the upwardly inclining surface scatters white light in all directions. Although this pavement marker may be usefull to relay information to a driver, its configuration with enclosed, downwardly inclining surfaces may be relatively difficult to fabricate.

Japanese Patent Kokoku (B2) No. HEI 5[1993]-33661 (Shinmi et. al.) discloses a sheet for road signs having optional convex molded shapes on the sheet's surface. Anchored on the convex molded shapes are reflective materials. The sheet comprises thermoplastic polymers and additives, such as fillers, pigments, plasticizers, and reflective materials. The convex molded shapes are made by forcing molten sheet material into a molding roller. The convex shapes are an integral part of the sheet. The molding roller determines features such as size, shape, and spacing of the convex shapes so that changes to those features cannot be made readily without changing the configuration of the molding roller, a situation similar to U.S. Pat. No. 4,988,541 (Hedblom).

Assignee's pending U.S. patent application Ser. No. 08/562,041 (filed Nov. 22, 1995) discloses a pavement marker that comprises a base sheet, a discontinuous polymeric layer adhered on the base sheet, and a plurality of particles, such as microspheres and skid resistant particles, partially embedded in the polymeric layer. The polymeric layer is a thermoset polymer comprising a blocked isocyanate crosslinker and is applied to the base sheet as a pattern, e.g., a repeating pattern of hexagons, by a continuous process such as screen printing. Although the pavement marker is very useful and although the manufacturing process is generally streamlined, the pattern of the polymeric layer is predetermined by the screen printing method and cannot be changed readily without equipment changes.

An alternate method to elevate the optical elements above the pavement surface is to use retroreflective elements or aggregates having a core material that is coated with a multitude of microspheres. Examples of such elements are disclosed in EP Patent No. 565,765 A2; U.S. Pat. Nos. 3,043,196; 3,171827; 3,175,935; 3,274,888; 3,418,896, 3,556,637; 4,983,458; and Assignee's pending U.S. patent application Ser. No. 08/503,532, filed Jul. 18, 1995. Although these retroreflective elements are extremely useful, some are not easily manufactured.

SUMMARY OF THE INVENTION

In view of the foregoing, a need still exists for a retroreflective article that can provide good retroreflectivity under wet conditions and that can be direction indicating while at the same time be manufactured through a streamlined process for making such articles. The present invention provides such a retroreflective article.

The inventive article has a profile of raised protuberances. Optical elements having different properties (for example, color, diameter, refractive index, and composition) are embedded in different portions of the protuberances or in an optional binder layer disposed on the protuberances. If a binder layer is used, it may have a different color in different portions of the protuberance. Because the protuberances elevate the optical elements from the pavement surface, water drains away from the retroreflective portions of the inventive article more efficiently to allow for a quick recovery of retroreflectivity after a respite of rainfall.

In brief summary, the inventive retroreflective article may comprise or consist essentially of: (a) a base sheet having first and second major surfaces; (b) a plurality of protuberances disposed on the first major surface of the base sheet; (c) at least two sets of optical elements, the first set being partially embedded in a first portion of the protuberances and the second set being partially embedded in a second portion of the protuberances, the second set having different properties than the first set; and (d) at least one light scattering agent that is in optical association with the optical elements such that incident light passing through the optical elements strikes the light scattering agent and is redirected towards its source.

The method of the invention may comprise or consist essentially of the steps: (a) providing a base sheet having protuberances and a light scattering agent; (b) partially embedding a first set of optical elements into a first portion of the protuberances such that the optical elements are in optical association with the light scattering agent; and (c) partially embedding a second set of optical elements into a second portion of the protuberances such that the optical elements are in optical association with the light scattering agent, and wherein the second set has different properties from the first set.

Pavement markings of the invention differ from known markings in that they are capable of being easily manufactured and provide an article with protuberances having different sets of optical elements embedded therein. Optical elements of different properties (for example, color, diameter, refractive index, and composition) can be readily deposited on different portions of the protuberances by using, for example, a substantially circular or curved web path for the base sheet and by taking advantage of the protuberance configuration. Unlike the prior art, direction indicating pavement markings of the invention incorporate an optical system that can be made by using different colored optical elements rather than different colored binder layers. Because optical elements are more easy to be selectively secured to the protuberances, the invention provides benefits over known directional protuberance-bearing markers.

In accordance with the invention, articles of the present invention are useful as direction indicating pavement markers to relay signal information to the motorists, such as warning the motorist that he or she is traveling in the wrong direction.

BRIEF DESCRIPTION OF THE DRAWINGS

The invention will be further explained with reference to the drawings, wherein.

These figures are idealized, are not to scale, and are intended to be merely illustrative and non-limiting.

DETAILED DESCRIPTION OF ILLUSTRATIVE EMBODIMENTS

Articles of the present invention rely on an optical system comprising sets of optical elements, that can be in the form of microspheres, embedded in different portions of the protuberances. The protuberances are formed on the first major surface of the base sheet. On the second major surface of the base sheet, there are optional reinforcing layers and adhesive layers to facilitate applying the inventive article to a surface, such as a roadway.

Figure 1:
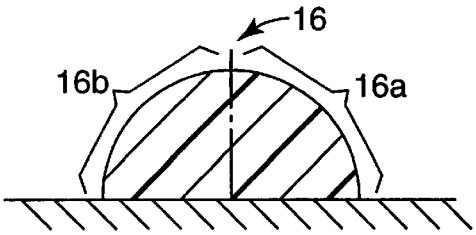
FIG. 1 is a cross-sectional view showing different portions of a protuberance 16 in accordance with the invention.

FIG. 1 shows an illustrative protuberance 16 of the invention having at least two portions, a first portion 16*a* and a second portion 16*b*. Each portion of the protuberance supports different sets of optical elements and can optionally support different color binder layers. The protuberance can support a variety of different sets of optical elements or different colored binder layers as desired.

Figure 2:
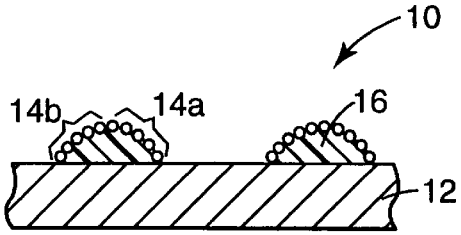
FIG. 2 is a cross-sectional view of retroreflective article 10 in accordance with the invention.

FIG. 2 shows an illustrative embodiment of the invention where a retroreflective article 10 contains a base sheet 12 that has optical element sets 14*a* and 14*b* partially embedded in different portions of the protuberances 16 that contain a light scattering agent (not shown).

Figure 3:
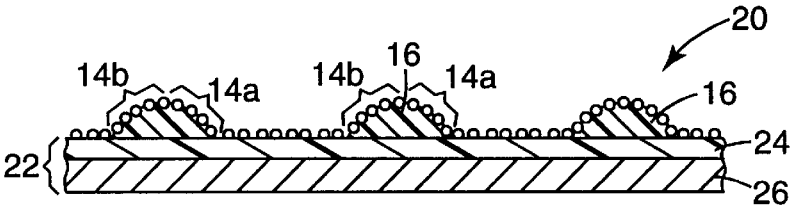
FIG. 3 is a cross-sectional view of another embodiment of retroreflective article 20 in accordance with the invention.

FIG. 3 shows another illustrative embodiment of the invention where a retroreflective article 20 contains a multilayer base sheet 22 having thermoplastic layer 24 containing a light scattering agent (not shown) disposed on conformance layer 26. Protuberances 16 contain a light scattering agent (not shown) and are adhered to thermoplastic layer 24. Optical element sets 14*a* and 14*b* are partially embedded in different portions of protuberance 16. Optical elements embedded in thermoplastic layer 24 can be either 14*a* or 14*b* or both.

Figure 4:
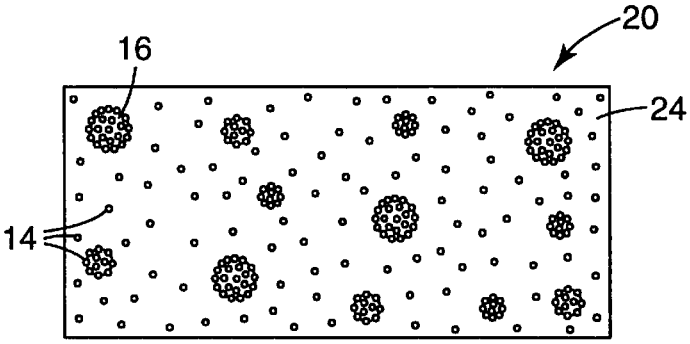
FIG. 4 is a plan view of the embodiment shown in FIG. 3.

FIG. 4 shows a plan view of the embodiment in FIG. 3 where protuberances 16 of different sizes are scattered randomly on thermoplastic layer 24 of base sheet 22 (not shown). Optical elements, generally shown as 14, are embedded in protuberances 16 and on thermoplastic layer 24 of base sheet 22 (not shown).

Figure 5:
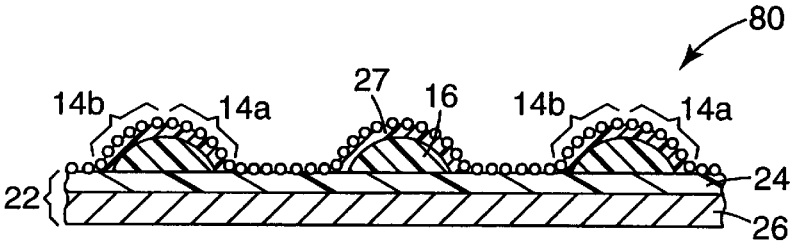
FIG. 5 is a cross-sectional view of another embodiment of retroreflective article 80 in accordance with the invention.

FIG. 5 shows another illustrative embodiment of the invention where retroreflective article 80 contains multilayer base sheet 22 having thermoplastic layer 24 disposed on conformance layer 26. Protuberances 16 are coated with binder layer 27, which contains a light scattering agent (not shown). Optical element sets 14*a* and 14*b* are partially embedded in binder layer 27 and on thermoplastic layer 24.

The protuberances elevate the optical elements above the substrate surface so that the optical elements are not submerged completely by water, and after a rainfall, the water can more readily drain away from the protuberances so that they can recover retroreflective performance rapidly. Typically, the protuberance is a raised polymeric core or body. In a preferred embodiment, thermoplastic protuberances are used. As used in this document, the term "thermoplastic protuberance" means a raised body or core that is thermoplastic—that is, capable of melting and flowing when exposed to a sufficient amount of heat. The protuberances optionally can include a binder layer disposed on the core. The binder layer may be a thermoplastic or thermoset polymer. The protuberances have different portions that support different sets of optical elements and optionally support different colored binder layers.

Unlike the protuberances disclosed in U.S. Pat. No. 4,988,555 (Hedblom) and Japanese Patent Kokoku (B2) No. HEI 5[1993]-33661 (Shinmi et al.), protuberances of the invention can be nonintegral, meaning that they do not have to be formed as a monolithic element with the base sheet—that is, the protuberance and base sheet do not need to be formed as a single component that lacks an interface therebetween.

The protuberances provide a profiled structure having a substantially vertical surface resulting in more efficient retroreflection. As between an article with a vertical profile, i.e., an article with protuberances, and one without a vertical profile, i.e., a substantially flat article, the one with a vertical profile provides generally more efficient retroreflection because the optical elements on the vertical surfaces are able to capture more incident light and reflect it back to its source.

The protuberances also provide an enhanced measure of wearability over similarly constructed flat articles without such protuberances. As used in this document, "wearability" means the ability of an article to withstand repeated impact and abrasion from vehicle tires thereby prolonging the useful life of the inventive article. Enhanced wearability of the inventive article is achieved because vehicle tires make contact with the protuberances first, thereby wearing them down before wearing down the remainder of the inventive article.

Illustrative examples of suitable polymers for use as protuberances include fluoropolymer, polycarbonate, acrylic, polyester, polyurethane, polyvinyl chloride, polyolefin copolymers, and blends thereof. The polymer chosen for the protuberance may be different from that of the thermoplastic layer of a multilayer base sheet. Care should be taken to select a material for the protuberance that has good adhesion to the base sheet, good adhesion to the optical elements, and is sufficiently durable to withstand repeated traffic impact. By "good adhesion" it is meant that the protuberances retain their adhesion to the base sheet and to the optical elements after repeated impact by vehicle tires.

The protuberances can be of essentially any desired shape in horizontal cross section, i.e., in a plane parallel to the marker base sheet when laid flat on a substrate. The horizontal cross section of the protuberance may be, for example, ellipsoidal, circular, oblong, rectangular, irregular, or regular. In some embodiments where optimum retroreflective brightness from all orientations is desired, e.g., a pavement marking for intersections, the horizontal cross section of the protuberance is preferably substantially circular because brightness from all orientations can be achieved. In general, a protuberance having circular cross section creates a substantially hemispherical protuberance, or some portion thereof.

The protuberances are about 0.2 to about 6.0 millimeters in height and about 1 to 20 millimeters in diameter to be of sufficient size so as not to be submerged completely by water in a typical rain shower. More preferably, the protuberances are about 1 to about 4 millimeters in height and are about 2 to about 8 millimeters in diameter at the base. The latter sizes are more preferred because they tend to provide a good balance between retroreflectivity and wearability, aid in draining water away from the retroreflective portions, and provide a wear surface to prolong the pavement marker's life. Protuberances that are too large may inhibit the retroreflective article's conformance to the substrate, resulting in a reduced adhesive bond. Pavement markers that employ protuberances that may be used in this invention are disclosed in Assignee's copending U.S. application Ser. No. 08/895,132, filed on the same day as this application, (Pavement Marking Having Raised Protuberances And Method Of Making)

As shown in FIG. 4, protuberances 16 may be spaced in a generally random manner. The random spacing can be achieved by freely depositing resin particles on the base sheet 12, 22 (FIGS. 2, 3, and 5). Base sheet 12, 22 may be heated so that once the polymeric particles contact the base sheet, they soften to yield protuberances of generally hemispherical shape. A less than optimum protuberance spacing may be used in applications where optimum brightness is not required. This feature of random, yet controllable protuberance placement permits a simplified, less expensive manufacturing process to be used in producing a pavement marking that has elevated optical elements.

If desired, to increase optical element adhesion, a binder solution can be coated and cured on the protuberances to yield a binder layer. The binder layer can be a thermoplastic or thermoset polymer. Preferred binder solutions suitable for use in the invention are disclosed in U.S. Pat. No. 4,988,541 (Hedblom), which refers to such solutions as "bead bond material." When a binder layer is used, optical elements will be embedded in it and not directly in the protuberances. In such a case, the binder layer contains about 5 to about 20 volume percent of a light scattering agent and the protuberance does not necessarily need to contain light scattering agents. The binder layer may optionally have different colorants on different portions of the protuberances. For example, in FIG. 1, a white pigment could be added to the binder solution and coated to a first portion 16*a*. Similarly a yellow pigment could be added to the binder solution and coated to a second portion 16*b*. U.S. Pat. No. 4,988,541 (Hedblom) discloses preferred coating methods for applying two different binder layers on to a protuberance.

The protuberances can have first and second layers, where the second layer lies under the first layer, the first layer comprising a polymer and a diffuse reflector pigment, and the second layer comprising a polymer and specular pigment (see U.S. Pat. No. 5,417,515 (Hachey et al.)). A dual reflecting layer protuberance could be made, for example, using polymeric particles with an inner body comprising a specular pigment and an outer sheath comprising a diffuse pigment. When a polymeric particle of such composition is exposed to heat to form a protuberance, the first outer layer should be of sufficient thickness so that the portion of the optical elements embedded in the protuberance contacts both the outer diffuse pigment layer and the inner specular pigment layer. Alternatively, a binder layer having a diffuse reflector pigment can be disposed on a protuberance comprising a polymer and a specular reflector pigment.

A dual layer reflecting protuberance can provide high retroreflectivity levels over a wide range of distances and entrance angles, regardless of the retroreflective article's orientation. The specular layer is best suited for returning light that enters close to normal, while the diffuse layer is best suited for returning light at the larger entrance angles between 65° and 90° from normal with respect to the plane formed by the protuberance in contact with the microspheres. Because the protuberance provides a vertical component, higher efficiency of retroreflectivity at driver geometry may be achieved.

Light scattering agents are in optical association with the optical elements. The term "optical association" means that when a light ray strikes the optical element and is refracted, the light ray is capable of striking the light scattering agent so that it can be reflected back into the optical elements. Typically, the light scattering agent resides in a layer that supports the optical elements—that is, in the protuberance or in the binder layer disposed on the protuberance. When the optical elements are partially embedded in the protuberance, it comprises a light scattering agent. When the optical elements are partially embedded in a binder layer disposed on the protuberance, the binder layer contains a light scattering agent and it is not necessary to have a light scattering agent in the protuberance.

Light scattering agents suitable for use in the present invention include specular pigments and diffuse pigments. Specular pigment particles are generally thin and plate like. Light striking the pigment particles is reflected at an angle equal but opposite to the angle at which it entered. Suitable examples of specular pigments for use in the invention include pearlescent pigments, mica, and nacreous pigments. Diffuse pigments are generally fine particles that are relatively uniform in size. The pigment particles tend to be oriented in many different directions, so that light hitting the particles is reflected back at a number of angles, including back along the path of incident light. An example of a preferred diffuse pigment is titanium dioxide.

Illustrative examples of suitable light scattering agents for use in protuberances include pigment particles selected from the group consisting of zinc oxide, zinc sulfide, lithophone, zircon, zirconium oxide, barium sulfate, titanium dioxide, and combinations thereof as disclosed in U.S. Pat. No. 5,286,682 (Jacobs et al.). These pigments reflect white light. Retroreflective articles using these pigments have the advantage of being able to reflect distinct night time colors without using potentially toxic metals such as cadmium, chromium, and lead-based pigments, when they are used in combination with colored optical elements.

Other light scattering agents may be used to reflect other colors. An illustrative example is bismuth vanadate, which reflects yellow light and can be used with colorless optical elements to yield a yellow pavement marking. Some organic lakes and organic pigments of controlled particle size may also be used.

Typically, the light scattering agents are present at about 5 to 20 volume percent of the layer supporting the optical elements, i.e., the protuberances or the binder layer, if used. Preferably, the scattering agents are present at about 5 to 15 volume percent and more preferably about 7 to about 13 volume percent. This latter range is preferred because it provides a good balance between the amount of scattering agents needed for reflectivity and flowability of the polymeric material during transformation to protuberances. As described above, the light scattering agents are present in the binder layer, if used, and in the protuberance. Furthermore, different portions of the protuberances or binder layer can comprise different types of light scattering agent. For example, the first portion of the protuberance can comprise a diffuse pigment while the second portion can comprise a specular pigment. Thus, at least one light scattering agent is in optical association with the optical elements. A light scattering agent might also include a layer of specularly reflective material such as a aluminum or silver metal or dielectric layer disposed in optical association with the optical elements.

The base sheets used in the present invention can have a single or a multilayer construction. The base sheet can be a single layer, or as shown in FIG. 3, it can be a multilayer laminate, e.g., a thermoplastic layer disposed on a conformance layer. Whether single or multilayer in construction, the base sheet is desirably conformable so as to be easily applied to a non-planar substrate.

In a multilayer base sheet construction, there is typically a thermoplastic layer disposed on a conformance layer. The conformance layer can be polymeric. U.S. Pat. No. 4,490,432 (Jordan) discloses an illustrative conformance layer that is suitable for use in the present invention. This type of conformance layer comprises a non-crosslinked elastomer (e.g., acrylonitrile-butadiene, neoprene, nitrile rubbers, and polyacrylates), a thermoplastic reinforcing polymer (e.g., polyolefins, vinyl copolymers, polyethers, polyacrylates, styrene-acrylonitrile copolymers, polyesters, polyurethanes, and cellulose derivatives), and a particulate inorganic filler (e.g., magnesium silicate, talc, and mica).

Another polymeric conformance layer suitable for use in the present invention is disclosed in U.S. Pat. No. 5,194,113 (Lasch et al.) which includes a ductile thermoplastic polymer and a nonreinforcing mineral particulate. This type of conformance layer comprises from about 50 to about 85 volume percent of thermoplastic polymer and about 15 to about 50 volume percent of the mineral particulate, the particulate having a mean particle size of at least one micrometer. Disclosed illustrative examples of suitable thermoplastic polymers included polyolefin, which may be chosen from the group consisting of polyethylene, ethylene copolymers, polypropylene, ethylene-propylene-diene terpolymers, polybutylene, and mixtures thereof Disclosed illustrative examples of suitable mineral particulate include, e.g., calcium carbonate, aluminum silicate, talc, alumina trihydrate, silica, wollastonite, mica, feldspar, barytes, calcium silicate, attapulgite, and various hollow beads of synthetic and natural minerals.

Yet another polymeric conformance layer suitable for use in the present invention is disclosed in U.S. Pat. No. 5,643,655 (Passarino) which is an essentially chlorine free conformance layer comprising a calandered, unvulcanized compound based on acrylonitrile butadiene rubber (NRB) and modifying agents to make an elastomer precursor. The modifying agents improve the mechanical and physical properties of natural or synthetic elastomer.

The conformance layer can be metallic. Metallic conformance layers should be of sufficient thickness so as to be ductile and conformable and yet have sufficient strength so as to be processable. Illustrative examples of suitable materials for use as metallic conformance layers include aluminum foil and copper foil. Aluminum foil is preferred because it has good conformance properties and is commercially available at a relatively low cost.

For ease of manufacturing, the thermoplastic layer may be laminated to or extruded directly on the conformance layer to yield a multilayer base sheet. In a multilayer construction, it is desirable to have good adhesion between the thermoplastic layer and the conformance layer. Illustrative examples of suitable materials for use as thermoplastic layer include polyolefin copolymers, polyurethane, polyvinyl chloride, and blends thereof Preferred polyolefin copolymers are ethylene methacrylic acid (EMAA) and ethylene acrylic acid (EAA) because they have very good adhesion to a variety of materials and are commercially available.

The thermoplastic layer may contain light scattering agents similar to those used in protuberances and binder layer. The light scattering agents comprises about 5 to about 20 volume percent of the thermoplastic layer. Preferably, light scattering agents are present at about 5 to about 15 volume percent, and more preferably about 7 to about 13 volume percent of the thermoplastic layer to provide a good balance between the amount of scattering agents needed for reflectivity and flowability of the thermoplastic layer during processing. The advantage of having light scattering agents in the thermoplastic layer is that any optical elements embedded therein will also retroreflect incident light. In FIG. 3, optical element sets 14*a* and 14*b* are embedded in protuberances 16 as well as thermoplastic layer 24, both of which retroreflect incident light. Typically the thermoplastic layer is less than 0.010 inch (0.25 mm) thick to provide a balance of properties with the conformance layers so as not to substantially inhibit conformability of the inventive article to the substrate. Preferably, the thermoplastic layer is about 0.002 to about 0.006 inch (0.05 to 0.2 mm) thick to strike a good balance between conformability and base sheet integrity.

The optical elements used in the present invention can be light transmissive microspheres. They act as spherical lenses that refract incident light into the protuberances or binder layer which contain the light scattering agent. The light scattering agents reflect a portion of the incident light to direct it back into the microsphere where the light is again refracted but this time back towards the light source.

Different portions of the protuberances or binder layer, if used, support different sets of optical elements. The optical elements can differ in properties such as color, diameter, refractive index, and composition. For example, in FIG. 1, protuberance portion 16*a* could support colorless optical elements, while in portion 16*b*, optical elements could have a yellow transparent colorant. If the protuberance contains a white pigment, for example, titanium dioxide, then portion 16*a* should retroreflect white light while portion 16*b* should retroreflect yellow light. In this way, a direction indicating pavement marking can be fabricated.

The microspheres can be glass or non-vitreous ceramic. Non-vitreous ceramic microspheres are typically preferred for greater durability and abrasion resistance. Preferred non-vitreous ceramic microspheres are disclosed in U.S. Pat. Nos. 4,564,556 (Lange); 4,758,469 (Lange); 4,772,511 (Wood et al.); and 4,931,414 (Wood). Glass microspheres can provide a desirable balance of lesser durability at lower cost. Typically, the microspheres are about 100 to about 600 micrometers (0.004 to 0.02 inch) in diameter and have a refractive index of about 1.5 to about 2.2.

As shown in FIG. 2, the microspheres may be placed only on the protuberances, if desired. Such selective placement is achieved by using a base sheet that is not receptive to the microspheres. A metal conformance layer, such as aluminum foil, is an illustrative example of such a base sheet. Other examples of conformance layers include crosslinked polymers or thermoplastic polymers that have higher melt temperature than the softening point of the protuberances.

The microspheres also can be deposited on the base sheet and the protuberances as shown in FIG. 3, where thermoplastic layer 24 of base sheet 22 is receptive to the microspheres. The microspheres can be deposited on the binder layer as shown in FIG. 5.

In pavement marking applications, it is important that motorists distinguish between different colored marker, e.g., between white and yellow markers. If desired, light transmissive colorants may be added to the microspheres to enhance both daytime and nighttime color. For example, a yellow colorant could be added to the microspheres to make a pavement marker that retroreflects yellow light. See, for example, U.S. Pat. No. 5,286,682 (Jacobs et al.).

Figure 6:
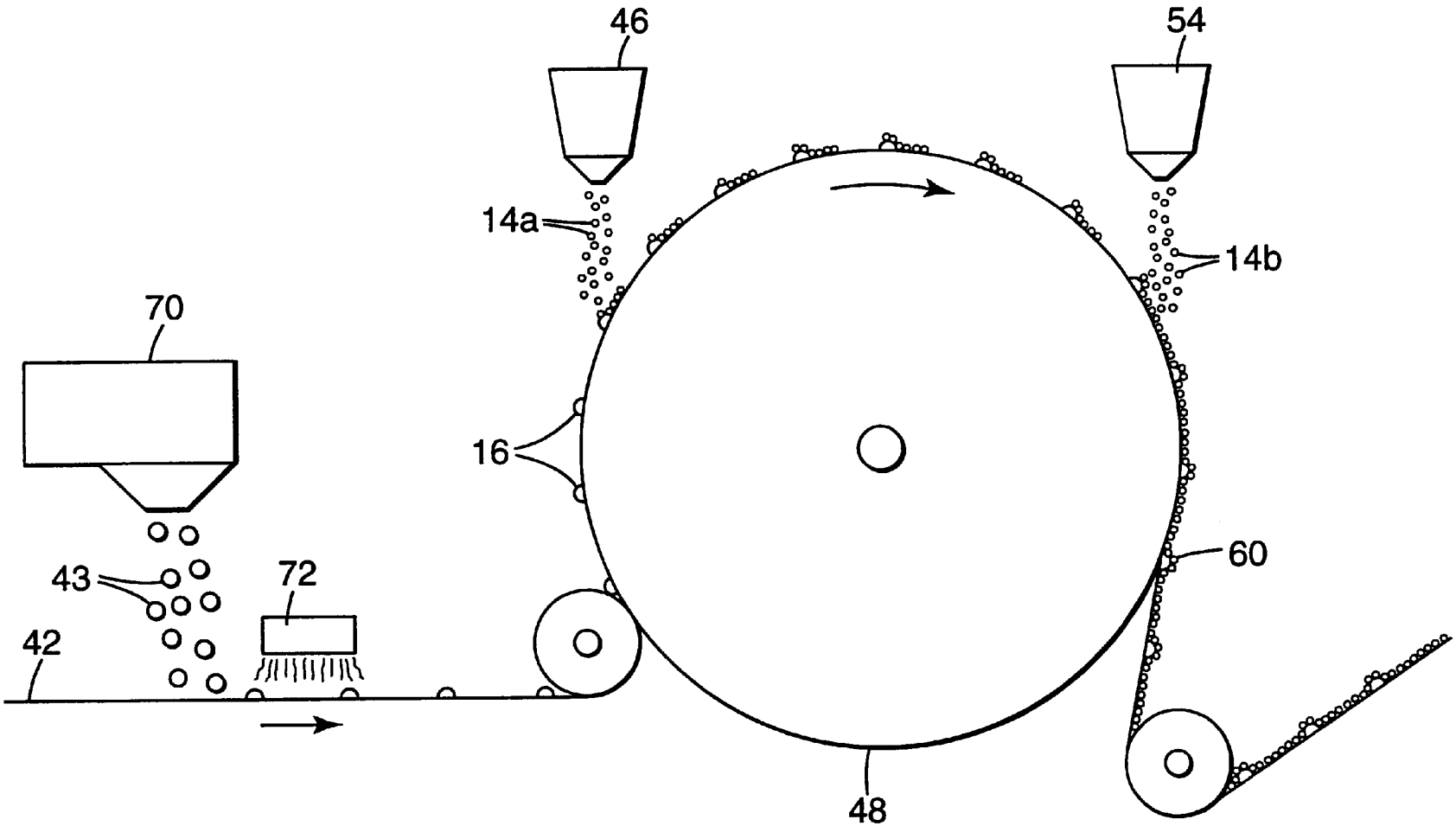
FIG. 6 is a schematic view of a method of making retroreflective article 60 in accordance with the invention.

FIG. 6 shows a process of making retroreflective article 60 of the invention. Reservoir 70 releases polymeric particles 43 containing a light scattering agent (not shown) on to base sheet 42. Heat source 72 begins to soften polymeric particles 43. As base sheet 42 contacts hot can 48 and takes a substantially circular path, polymeric particles 43 further soften, melt, and deform to yield protuberances 16. On the upward portion of the circular path, a first applicator 46 releases a first set of optical elements 14*a* and with the aid of gravity, the optical elements 14*a* are partially embedded in a first portion of the protuberances. Some of the optical elements 14*a* can partially embed in the base sheet if it is receptive to optical elements. The base sheet continues to traverse hot can 48 until it meets a second applicator 54 on the downward portion of the circular path. Applicator 54 releases a second set of optical elements 14*b* and with the help of gravity, the optical elements are partially embedded in a second portion of the protuberances. Some of the optical elements 14*b* can partially embed in the base sheet if it is receptive to optical elements. Other methods of partially embedding optical elements into the protuberances include mechanical or pneumatic means. An illustrative example of a pneumatic means is the use of a jet of substantially inert gas to partially embed the optical elements in the protuberances. An illustrative example of a mechanical means is the use of an impeller to throw the optical elements towards the protuberances. Those skilled in the retroreflective arts will take care to position the applicators 46 and 54, as well as to control other processing variables (such as line speed, amount of heat exposure, et cetera) to get the desired coating of optical elements on the protuberances and on the base sheet. If desired, a third applicator could release a third set of optical elements to be partially embedded in a third portion of the protuberances.

Preferably, different sets of optical elements, such as the first set, the second set, and if used, the third set, are of different colors and can also be of different diameters, refractive index, and composition. For example, optical element set 14*a* can be colorless glass microspheres having a refractive index of about 1.9 while optical element set 14*b* can be a transparent red ceramic microspheres having a refractive index of about 2.2 both sets of optical elements being partially embedded in a protuberance comprising a white pigment, such as titanium dioxide. In this way, a direction indicating pavement marking can be made to retroreflect white light in a first direction and red light in a second, opposite direction. Such a pavement marker should be effective to warn motorists from traveling in the second direction.

A variety of heat sources can be used to soften polymeric particles into protuberances. As shown in FIG. 6, hot can 48 supplies the heat to soften polymeric particles 43. A heated oven can also be used to soften the particles. For example, as the base sheet moves through an oven, the polymeric particles previously deposited thereon soften, melt, and deform into protuberances. Also, a base sheet carrying polymeric particles can be made to pass under banks of radiant heaters, such as Calrod™ heaters or infrared lamps, to deform the particles into protuberances.

The final shape of the protuberances can vary depending on, for example, (1) the processing conditions such as the temperature and method of heating, (2) the original shapes of the polymeric particles, (3) the melting characteristic of the polymeric particles, and (4) the surface of the base sheet that comes into contact with the polymeric particles. If there is substantial amount of heat causing the polymeric particles to soften substantially, the final shape of the protuberance may be quite flat. If there is not as much heat, the final shape of the protuberance may be more hemispherical. When the polymer particles are applied randomly and then subsequently heated, some particles may flow together upon heating. Although the resulting protuberance may not have substantially hemispherical shape, there is generally still significant reflectivity from this now ellipsoidal protuberance.

The density and spacing of the protuberances can be changed easily by changing the base sheet web speed, changing the size of the polymeric particles, or changing the rate of particle deposition.

In the fabrication process, it is typical to add skid resistant particles, if desired, at the same time or just after the optical elements are deposited on to the base sheet. The optical elements and skid resistant particles are applied to the first major surface, i.e., the top surface of the base sheet by, e.g., sprinkling, scattering, et cetera. Examples of conventional skid-resistant particles include corundum (aluminum oxide) and quartz (sand, silicon dioxide, or micronized quartz). Preferred skid-resistant particles are disclosed in U.S. Pats. No. 4,937,127 (Haenggi et al.); 5,053,253 (Haenggi et al.); 5,094,902 (Haenggi et al.); and 5,124,187 (Haenggi et al.).

Components of the inventive article that lie underneath the retroreflective base sheet are preferably selected to fit the application desired. For example, a scrim adhesive (i.e., a polymeric scrim that has been saturated with an adhesive) imparts additional strength, for example, for strength in removablility or for other desired wear characteristics, as well as selected adhesive characteristics to the retroreflective article.

EXAMPLE

The following example is provided to illustrate different embodiments and details of the invention. Although the example serves this purpose, the particular ingredients and amounts used as well as other conditions and details are not to be construed in a manner that would unduly limit the scope of this invention.

A white pavement marking of the invention could be made as follows. Extrude a white film of about 0.0045 inch (0.11 mm) thick on to a 0.003 inch (0.076 mm) thick deadsoft aluminum foil carrier to yield a multilayer base sheet by using white resin pellets of Nucrel™ 699, an ethylene methacrylic acid copolymer (EMAA), available from Du Pont Company, Wilmington, Del., containing 20 weight percent titanium dioxide.

Bring the multilayer base sheet, at a rate of 3.8 feet per minute (0.91 m/min), into contact with a hot can having a diameter of about 2 feet (0.6 m), with the foil side contacting the hot can at a temperature of about 400° F. (204° C.), sufficiently hot to bring the white film to a nearly molten condition. Sprinkle the pigmented cylindrical particles of EMAA, with a 0.039 inch (1 mm) diameter and a 0.079 inch (2 mm) height, having 50 weight percent titanium dioxide on to the EMAA side of the base sheet. Coat the pigmented particles on to the base sheet after about 2 to 3 inch (5 to 8 cm) of wrap on the hot can. As the particle coated base sheet continues to traverse the surface of the hot can, the initial cylindrical shape of the particle softens and takes on a generally hemispherical shape to yield protuberances. This base sheet then travels under a first particle coater from which a first set of colorless glass microspheres having about 1.9 refractive index can be sprinkled on the first portion of the protuberance. As the base sheet continues to traverse the hot can, sprinkle a second set of yellow transparent microspheres on to a second portion of the protuberance. Cool the base sheet under ambient condition after it leaves the surface of the hot can and prior to winding it up.

All references cited herein are wholly incorporated by reference in this document.

What is claimed is:

1. A retroreflective article that comprises:

(a) a base sheet having first and second major surfaces;

(b) a plurality of protuberances disposed on the first major surface of the base sheet;

(c) at least two sets of optical elements, the first set being partially embedded in a first portion of the protuberances and the second set being partially embedded in a second portion of the protuberances, the second set having different properties than the first set; and (d) at least one light scattering agent that is in optical association with the optical elements such that incident light passing through the optical elements strikes the light scattering agent and is redirected towards its source.

2. The retroreflective element of claim 1 further comprising a third set of optical elements in optical association with the light scattering agent, the third set partially embedded in a third portion of the protuberances and having different properties that the first two sets.

3. The retroreflective element of claim 2, wherein the sets of optical elements are different in at least one property selected from the group consisting of color, size, refractive index, and composition.

4. The retroreflective article of claim 1, wherein the optical elements in the first set are colored distinctly different from the optical elements in the second set.

5. The retroreflective article of claim 1, wherein a binder layer is disposed on the protuberances comprises about 5 to about 20 volume percent of the light scattering agent.

6. The retroreflective article of claim 1, wherein the base sheet comprises a conformance layer.

7. The retroreflective article of claim 1, wherein the base sheet comprises a layer selected from the group consisting of ductile metals, thermoset polymers, and thermoplastic polymers having a melting point higher than the softening point of the protuberances.

8. The retroreflective article of claim 6, wherein the base sheet further comprises a thermoplastic layer disposed on the conformance layer.

9. The retroreflective article of claim 8, wherein the thermoplastic layer is of a different composition than the thermoplastic material of the protuberances.

10. The retroreflective article of claim 8, wherein the thermoplastic layer comprises about 5 to about 20 volume percent of the light scattering agent.

11. The retroreflective article of claim 1, wherein the protuberances comprise thermoplastic material selected from the group consisting of fluoropolymer, polycarbonate, acrylic, polyester, polyurethane, polyvinyl chloride, polyolefin copolymers, and blends thereof.

12. The retroreflective article of claim 1, wherein the protuberances are placed randomly on the first major surface of the base sheet.

13. The retroreflective article of claim 1, wherein the protuberances are in contact with less than 50 percent of the surface area of the base sheet.

14. The retroreflective article of claim 1, wherein the protuberances are in contact with about 10 percent to about 40 percent of the surface area of the base sheet.

15. The retroreflective article of claim 1, wherein the protuberances are randomly shaped.

16. The retroreflective article of claim 1, wherein at least some of the protuberances have a rounded profile in horizontal cross section.

17. The retroreflective article of claim 1, wherein the protuberances have an average height of about 200 to about 6000 microns.

18. The retroreflective article of claim 1, wherein the protuberances have an average height of about 1000 to about 4000 microns.

19. The retroreflective article of claim 1, wherein the protuberances comprise about 5 to about 20 percent by volume of a light scattering agent.

20. The retroreflective article of claim 1, wherein the light scattering agent includes pigment particles selected from the group consisting of zinc oxide, zinc sulfide, lithophone, zircon, zirconium oxide, barium sulfate, titanium dioxide, and combinations thereof.

21. The retroreflective article of claim 1, wherein the light scattering agent includes pigment particles selected from the group consisting of pearlescent pigments, mica, nacreous pigments, and combinations thereof.

22. The retroreflective article of claim 1, wherein the optical elements have an average refractive index of about 1.5 to about 2.2.

23. The retroreflective article of claim 1 further comprising a colorant in at least one of the group consisting of the base sheet, protuberances, and optical elements.

24. The retroreflective article of claim 1 further comprising skid-resistant particles that are partially embedded in the protuberances.

25. A method for making a retroreflective article comprising:

(a) providing a base sheet having protuberances and a light scattering agent;

(b) partially embedding a first set of optical elements into a first portion of the protuberances such that the optical elements are in optical association with the light scattering agent; and (c) partially embedding a second set of optical elements into a second portion of the protuberances such that the optical elements are in optical association with the light scattering agent, and wherein the second set has different properties from the first set.

26. The method of claim 25 further comprising partially embedding a third set of optical elements into a third portion of the protuberances such that the optical elements are in optical association with the light scattering agent, and wherein the third set has different properties from the first two sets of optical elements.

27. The method of claim 26, wherein the sets of optical elements are different in at least one property selected from the group consisting of color, size, refractive index, and composition.

28. The method of claim 25, wherein the protuberances comprise thermoplastic particles.

29. The method of claim 25 further comprising heating the protuberances to a softened state so as to be receptive to the optical elements.

30. The method of claim 25 further comprising depositing optical elements on the protuberances by use of gravity.

31. The method of claim 30, wherein after step (a), the base sheet is allowed to form a substantially circular path where the first set of optical elements is deposited on an upward portion of the circular path and a second set of optical elements is deposited on a downward portion of the circular path.

32. The method of claim 25 further comprising applying a binder layer to the protuberances after step (a) and before steps (b) and (c).

* * * * *